US008312851B2

(12) United States Patent
Heinemann

(10) Patent No.: US 8,312,851 B2
(45) Date of Patent: Nov. 20, 2012

(54) SWITCHABLE FINGER LEVER

(75) Inventor: Robert Heinemann, Weisendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 265 days.

(21) Appl. No.: 12/833,261

(22) Filed: Jul. 9, 2010

(65) Prior Publication Data

US 2011/0023806 A1 Feb. 3, 2011

(30) Foreign Application Priority Data

Jul. 31, 2009 (DE) ..... 10 2009 035 531

(51) Int. Cl.
*F01L 1/18* (2006.01)

(52) U.S. Cl. ..... 123/90.39; 123/90.44; 74/559; 74/569

(58) Field of Classification Search ..... 123/90.39, 123/90.44; 74/559, 567, 569
See application file for complete search history.

(56) References Cited

U.S. PATENT DOCUMENTS 7,328,675 B2 * 2/2008 Seitz et al. ..... 123/90.39

FOREIGN PATENT DOCUMENTS

DE 10220904 4/2005

* cited by examiner

*Primary Examiner* — Ching Chang
(74) *Attorney, Agent, or Firm* — Volpe and Koenig, P.C.

(57) ABSTRACT

A switchable finger lever (1) for a valve train of an internal combustion engine is provided. The finger lever includes an inner lever (2) with a U-shaped cross-section having, on one end (3), outer arms (4) which are made separately from each other and are pivotable relative to the inner lever (2). The outer arms extend, while flanking outer walls (6) of the inner lever (2), in a direction of the other end (5), and have on upper sides (7), running surfaces (7*a*) for high-lift cams. A support (10) having integrally connected lateral guide tabs (11) for at least one gas exchange valve extend on an underside (8) of a crossbar (9) of the inner lever (2) in a vicinity of the one end (3). An insert (12) having a contact surface (13) for a head of a support element is installed on the another end (5) between side walls (14) of the inner lever (2), and has a coupling slide (15) for an optional connection of the outer arms (4) to the inner lever (2). At least one resetting spring (16) is clamped between the inner lever (2) and the outer arms (4) in the region of the other end (5), and at least one of the inner lever (2), alone, or the inner lever (2) and the outer arms (4) are made of thin-walled sheet metal.

16 Claims, 4 Drawing Sheets

SWITCHABLE FINGER LEVER

CROSS-REFERENCE TO RELATED APPLICATIONS

This application claims the benefit of German Patent Application No. 10 2009 035 531.6, filed Jul. 31, 2009, which is incorporated by reference herein as if fully set forth.

FIELD OF THE INVENTION

The invention concerns a switchable finger lever for a valve train of an internal combustion engine, with the finger lever comprising an inner lever and further comprising, on one end, outer arms which are pivotable relative to the inner lever and extend, while flanking outer walls of the inner lever, in the direction of the other end, with the outer arms comprising on upper sides, running surfaces for high-lift cams, a support for at least one gas exchange valve extending on an underside of a crossbar of the inner lever in a vicinity of the one end, a contact surface for a head of a support element being provided on the another end, with the finger lever further comprising a coupling slide for an optional connection of the outer arms to the inner lever, and at least one resetting spring being clamped between the inner lever and the outer arms.

BACKGROUND

Finger levers known from the prior art (such as DE 102 20 904 B4) have a solid configuration and their realization is only possible through complex and expensive fabrication methods. It is further conspicuous that economic fabrication methods cannot be used and, at least partially, it is not possible to have recourse to standard parts for the lever.

SUMMARY

The object of the invention is therefore to provide a switchable finger lever of the above-noted type in which the aforesaid drawbacks are eliminated. In particular, it is intended to provide a switchable finger lever which is easy to manufacture at lower costs and in which, it is possible, at least partially, to have recourse to standard elements.

The invention achieves the above object in that the inner lever is made of thin-walled sheet steel and has a U-shaped cross-section, and the outer walls are configured as separate pieces from each other and made, optionally, likewise out of thin-walled sheet steel. The inner lever comprises, in a region of the one end, integrally connected lateral guide tabs for the gas exchange valve, a separate insert comprising the contact surface is installed in a region of the other end between side walls of the inner lever. The coupling slide is seated in this insert, and the resetting spring likewise extends in the region of the other end between the inner lever and the outer arms.

The aforesaid drawbacks are effectively eliminated through the above measures. Preferably, but not exclusively, both parts of the finger lever (inner lever, outer arms) are made out of thin-walled sheet steel by a punching and bending method. However, it is also envisioned to make only the inner lever out of sheet steel and the outer arms which are discrete parts and not connected through a crossbar, for instance, by casting.

In a particularly preferred development of the invention, it is proposed to have recourse to a standard finger lever of a non-switchable type (see for example, DE 198 11 658 B4). In this case, only minor modifications, such as provision of a recess in the crossbar for accommodating the separate insert with the coupling slide provided by the invention are needed.

The novel finger lever can be configured as a so-called lift alteration switch [full lift-partial lift] or as a lift deactivator [full lift-zero lift].

Because the outer arms are made as separate components from each other, their manufacture is as simple as imaginable. Where appropriate, they can be configured identically. Moreover, it is obvious that their discrete and thin-walled configuration results in a saving of mass.

It is further provided to connect the separate insert arranged on the other end of the finger lever through positive engagement to side walls of the inner lever. For this purpose, two crosswise extending axles are seated in the side walls of the inner lever and inserted through corresponding cross-bores of the insert. Alternatively, it is also conceivable to connect the separate insert to the inner lever solely by force-locking or by a combination of force-locking and positive engagement. If need be, the insert can also be connected by welding or the like.

The present finger lever possesses a low mass moment of inertia because, among other things, important parts of the finger lever, such as the resetting spring and the coupling mechanism in the region of its mounting support are positioned on a head of a support element.

In addition, it is advantageous if the end pieces of the lever-distal axle for fixing the insert project beyond the outer walls of the inner lever. In this way, a coil assembly of the resetting spring, configured preferably but not exclusively in the form of a torsion leg spring, can be mounted on each of the projecting end pieces.

Simple stops for the resetting spring (lost motion spring) are created by the fact that a first leg bears against an underside of the respective outer arm and a second leg abuts against the outer longitudinal end of the insert, that is to say, behind the insert.

In place of two separate torsion leg springs, it is also possible to use an assembled unit comprising two coil assemblies whose second legs can be connected to each other behind the outer longitudinal end of the insert.

As provided by the invention, the inner lever has a simple U-shaped cross-section that is generated preferably by a punching and bending method. An inverted U-profile or an H-profile is also conceivable.

Further, the guide tabs for the lateral guidance of the gas exchange valve advantageously project integrally from the inner liver. They can be configured, for instance, as prolongations of its inner walls on one end and be bent over onto an underside of the finger lever. However, it is also conceivable to make the guide tabs by a stamping method.

According to a further development of the invention, the coupling piston in the insert is not loaded directly by hydraulic medium or by a compression spring. The coupling piston is seated, namely, in a recess of a longitudinally extending entraining piston arranged in the insert. It is exactly this entraining piston that is loaded hydraulically in one direction of displacement and in the other direction of displacement, through the force of at least one spring element. Its loading through other a servo such as an electromagnetic actuator or a loading in both directions by a hydraulic medium is also conceivable.

As a mechanical spring for displacing the coupling slide in one direction (here, uncoupling direction), one embodiment of the invention provides a sheet metal clip. This can be made and mounted in a simple manner. Each side strip of the sheet metal clip acts in push-out direction on a respective protruding end of the coupling slide.

Another aspect of the invention is to provide at least one splash oil channel extending through the insert to its upper side. This splash oil channel can lead to the cam running surfaces. It would also be conceivable to route the hydraulic medium directly towards the cam contact region.

If the finger lever is configured as a lift alteration switch, another development of the invention provides arranging a rotatable roller between the side walls of the inner lever. However, it is also conceivable and intended to use a sliding contact in this region. It is further possible to provide the outer arms with a roller contact or a disk contact.

The running surfaces of the outer arms are configured as slightly arched sliding surfaces which may also be provided with deposited anti-wear coatings.

Last but not least, the invention provides a simple method of connecting the outer arms to the inner lever. To this end, an axle projects through the side walls of the inner lever on the one end, and the outer arms, which are freely movable relative to each other, are mounted on the outwards protruding ends of the axle. An anti-loss device for the outer arms may be provided, for instance, by snap rings seated on the axle or by other similar measures.

DETAILED DESCRIPTION OF THE PREFERRED EMBODIMENTS

Figure 4:
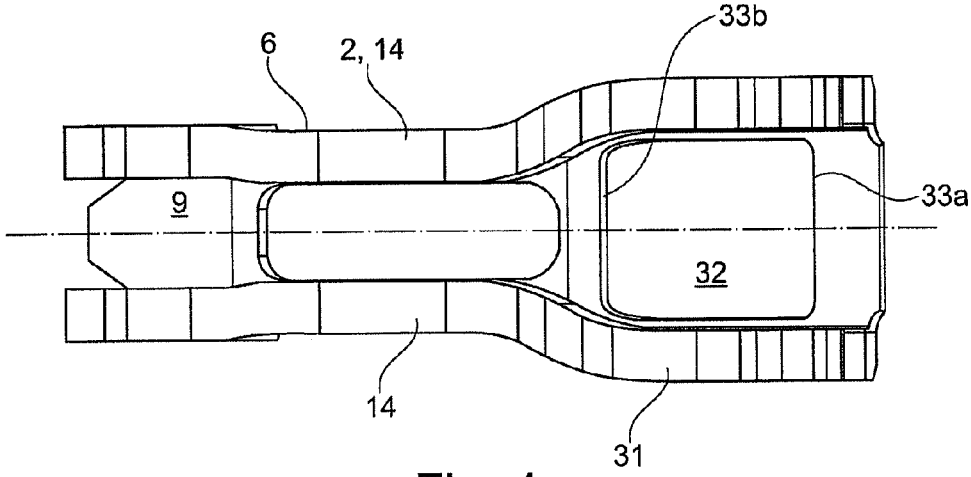
FIG. 4, a top view of the inner lever of FIG. 3.
Figure 5:
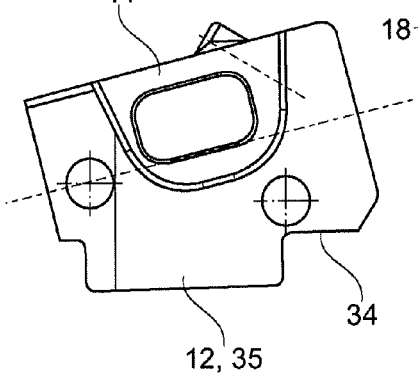
FIG. 5, a side view of the insert.
Figure 6:
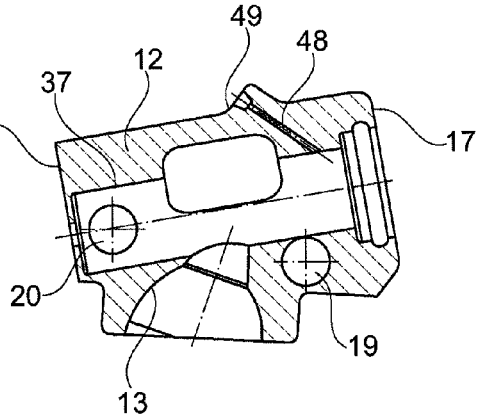
FIG. 6, a longitudinal section through the insert of FIG. 5.

The figures show a switchable finger lever 1 for a valve train of an internal combustion engine. The finger lever 1 has a U-shaped inner lever 2 made of thin-walled sheet steel. The inner lever 2 comprises two substantially upright side walls 14 with outer walls 6 (see also FIG. 4). On an underside 8, the inner lever 2 comprises, in the region of one end 3, a support 10 for a gas exchange valve. Guidance of the gas exchange valve is effected through two guide tabs 11 that project integrally from front end 36 of the inner lever 2 on the one end 3 and are bent through 180° to extend onto the underside 8.

Figure 2:
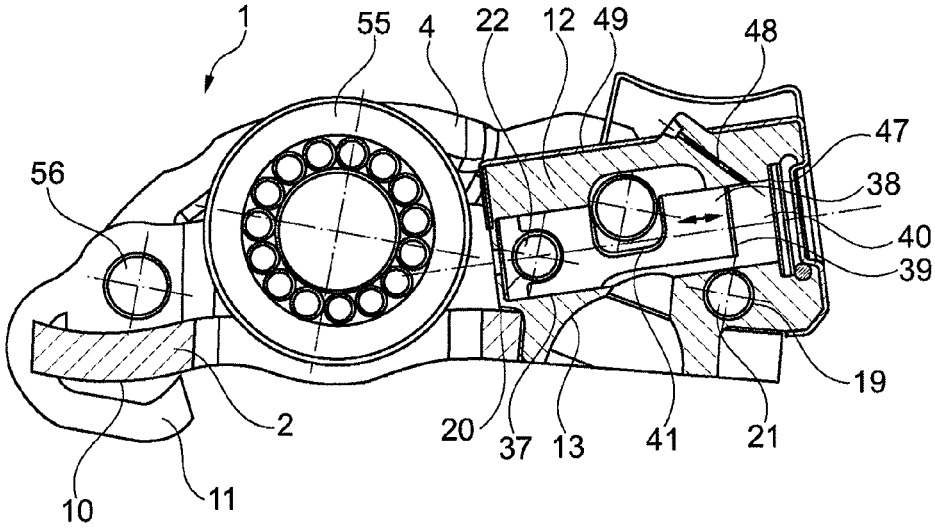
FIG. 2, a longitudinal section through the finger lever of FIG. 1.
Figure 3:
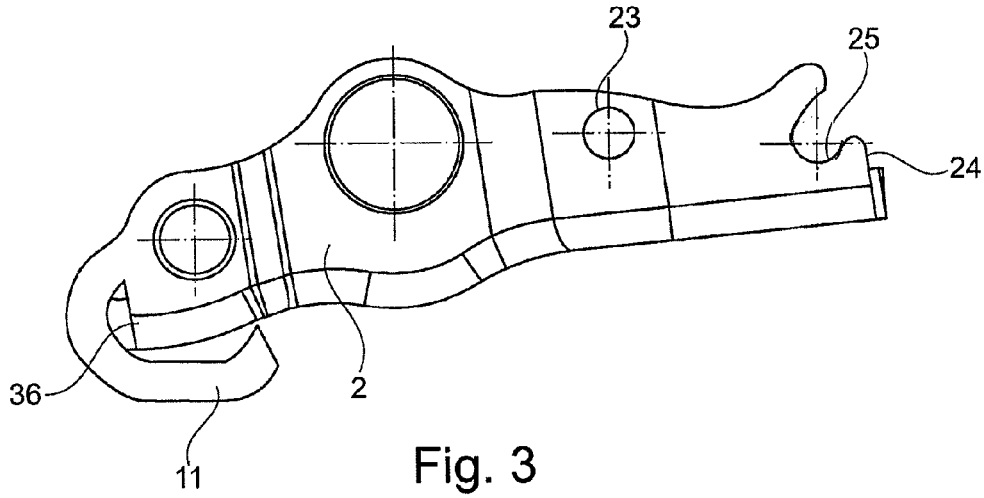
FIG. 3, a side view of the inner lever.

In the region of the other end 5, the inner lever 2 is widened into a fork-shape and comprises a recess 32. As best shown in FIG. 2, a rolling bearing-mounted roller 55 is installed between the side walls 14 of the inner lever 2 as a contact partner for a low-lift cam.

In the region of the one end 3, an axle 56 extends through the side walls 14 of the inner lever 2, one of the outer arms 4 being pivotally mounted on each of the ends of the axle 56 protruding beyond the outer walls 6. The outer arms 4 are likewise made of sheet steel. Each outer arm 4 comprises an upper side 7 comprising a corresponding running surface 7*a* for a high-lift cam. If appropriate, the finger lever 1 may also comprise only one outer arm 4.

The outer arms 4 are substantially smooth-faced and extend snugly on the outer walls 6 of the inner lever 2. However, the outer arms 4 do not extend over the entire length of the inner lever 2. Each outer arm 4 comprises on an underside in the region of the other end 5, an entraining surface 45 for a coupling slide 15 described later.

In the aforesaid recess 22 of the inner lever 2 on the other end 5 is seated a separate insert 12 which projects with an extension 35 into the recess 32, so that an underside 34 of the insert 12 protrudes beyond transverse edges 33*a*, 33*b* of the recess 32. The insert 12 is connected to the inner lever 2 by positive engagement. The insert 12 comprises two cross-bores 19, 20. An axle 22 whose ends are seated in bores of the side walls 14 of the inner lever 2 extends through the cross-bore 20. For lodging a further axle 21 (in the cross-bore 19), the inner lever 2 comprises in the region of front ends 24 of its side walls 14 on the another end 5, a jaw-like open configuration, so that end pieces 26 of the axle 21 are received between jaw surfaces 25.

A contact surface 13 for mounting the finger lever 1 on a head of a support element, not shown, is formed in the aforesaid extension 35 of the insert 12. This contact surface 13 is represented in the present case as a semi-spherical cavity.

As can best be seen in FIG. 2, the insert 12 comprises a longitudinal bore 37 with an entraining piston 38 displaceable therein. The latter defines with its outer front end 39 on the side of the other end 5, a pressure chamber 40 for hydraulic medium. The pressure chamber 40 is closed axially outwards through a separate closing element 47 (plug) and is supplied with hydraulic medium through the aforesaid contact surface 13.

A splash oil channel 48 leads from the pressure chamber 40 to an upper side 49 of the insert 12. Thus, a supply of hydraulic medium to the contacting cams and running surfaces 7*a*, 55 (running surface, roller) on the finger lever 1 can be realized through the splash oil channel 48.

The entraining piston 38 comprises a cut-out 41 starting from its upper side and extending in transverse direction. The above-mentioned coupling slide 15 is seated in this cut-out 41 and its ends extend through oblong holes 43 in the insert 12.

Figure 1:
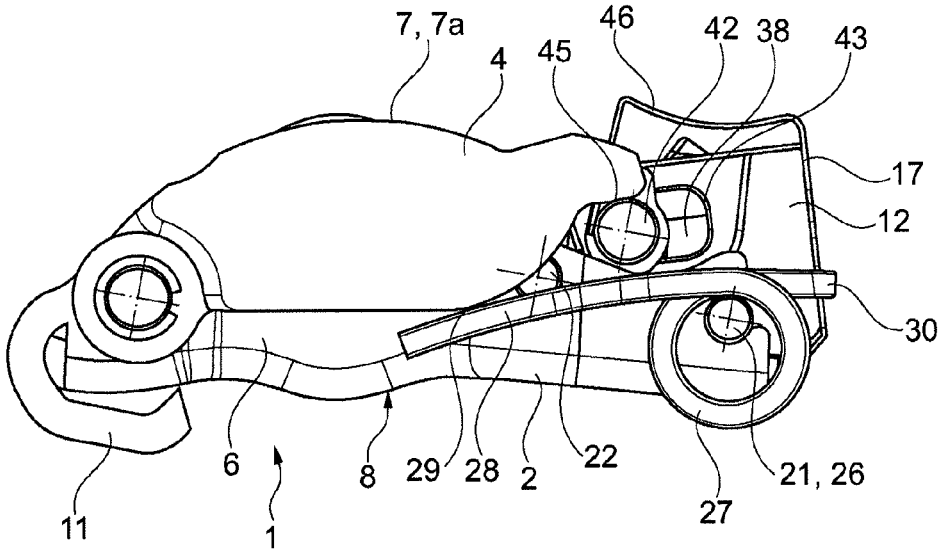
FIG. 1, a side view of a finger lever of the invention.
Figure 7:
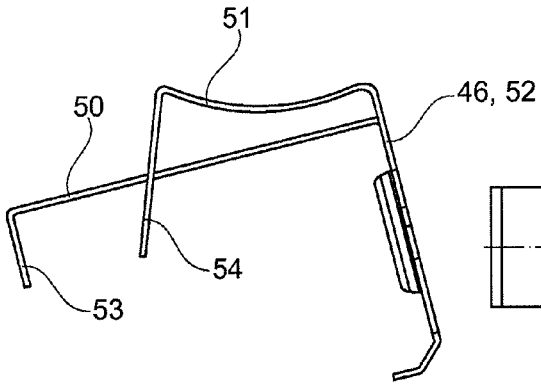
FIG. 7, a side view of the spring means for resetting the coupling slide.
Figure 8:
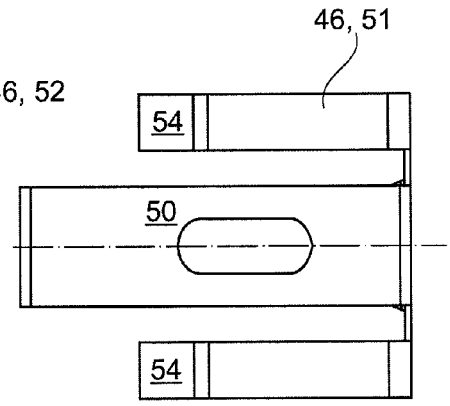
FIG. 8, a top view of the spring means of FIG. 7.
Figure 9:
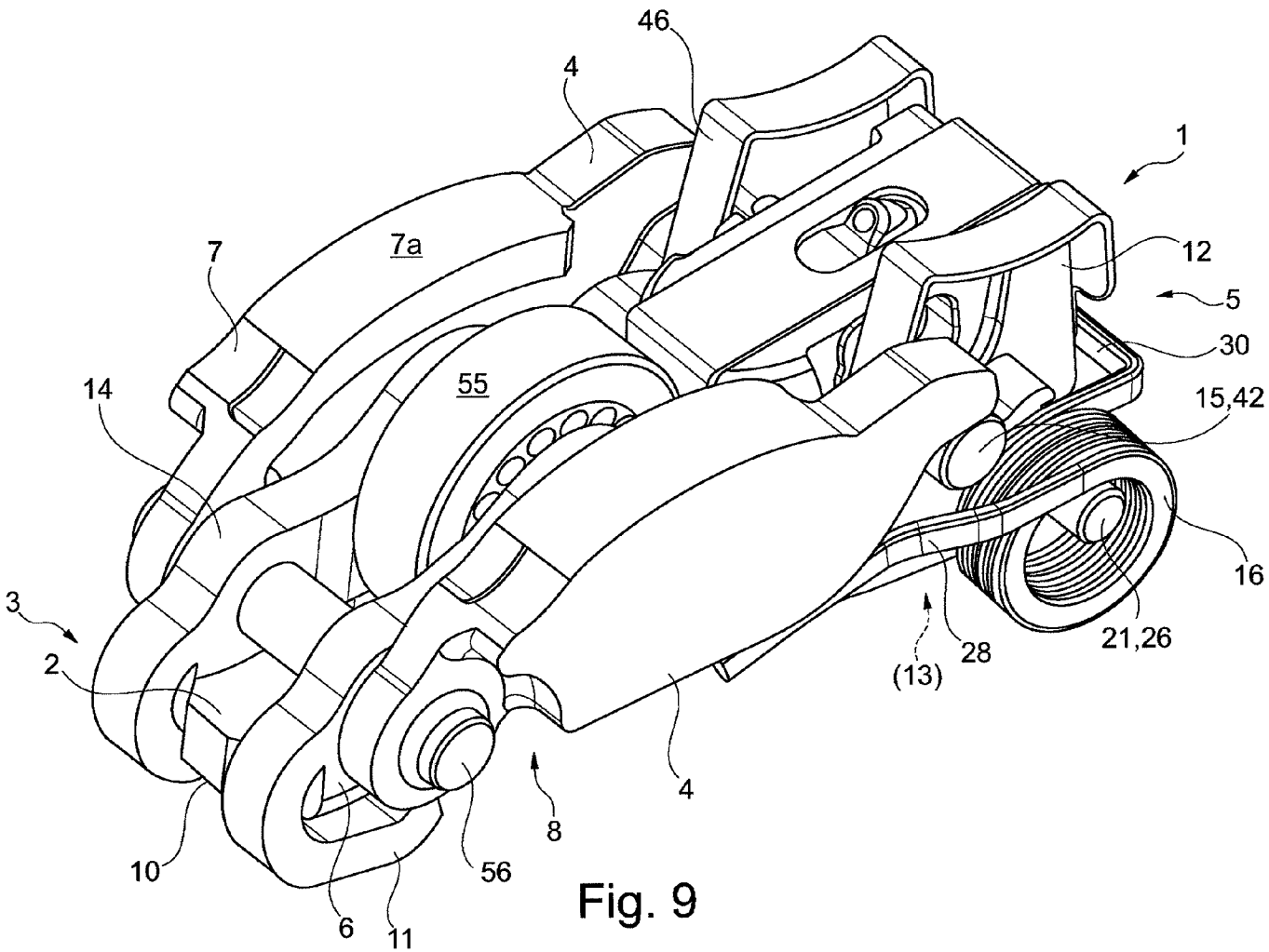
FIG. 9, a three dimensional view of the finger lever.

As best disclosed in FIG. 1 in combination with FIGS. 7 and 8, a spring 46 projects outwards from an upper side 49 of the insert 12. This spring 46 is made up substantially of three sheet metal strips which are joined at one end to a perpendicularly projecting connecting metal sheet 52. A center strip 50 is bent with one of its ends 53 over the insert 12 and thus fixed thereon. Laterally of the center strip 50 are disposed side strips 51 with bent-over ends 54. As shown in FIG. 9, these ends 54 act on the end pieces 42 of the coupling slide 15 in direction of the another end 5.

If a high valve lift is desired (coupled state), the aforesaid pressure chamber 40 is pressurized through hydraulic medium pressure in the cam base circle phase. This causes the entraining piston 38 with the inserted coupling slide 15 to be displaced in direction of the one end 3, so that the end pieces 42 of the coupling slide 15 are displaced into a position under the entraining surfaces 45 of the outer arms 4. Thus, the finger lever 1 follows the lift of the high-lift cam now loading the running surfaces 7*a* of the outer arms 4.

If uncoupling is desired (low lift), the high pressure in the pressure chamber 40 is switched off, at the latest, with the cam base circle phase. Now, the spring 46 comes into play which, through the ends 53 of its side strips 51 disengages the coupling slide 15 from the entraining surfaces 45 of the outer arms 4. Thus, during the next cam lift, the outer arms 4 pivot without load and the finger lever 1 follows the low lift of the cam then loading the inner lever 2.

A resetting of the outer arms 4 is accomplished through a resetting spring 16 configured, in the present case, as a torsion leg spring assembly. One coil assembly 27 of the resetting spring 16 is seated on each protruding end piece 26 of the axle 21. A first leg 28 engages an underside 29 of the respective outer arm 4. A second leg 30 extends to behind the other end 5 of the inner lever 2 and is connected there to the further second leg 30 of the other coil assembly 27.

LIST OF REFERENCE NUMERALS

1 Finger lever
2 Inner lever
3 One end
4 Outer arm
5 Other end
6 Outer wall of inner lever
7 Upper side of outer arm
7*a* Running surface
8 Underside
9 Crossbar
10 Support
11 Guide tab
12 Insert
13 Contact surface
14 Side wall
15 Coupling slide
16 Resetting spring
17 Outer longitudinal end of insert
18 Inner longitudinal end of insert
19 Cross-bore of insert
20 Cross-bore of insert
21 Axle
22 Axle
23 Bore of side wall
24 Front end of side wall
25 Jaw surface
26 End piece of lever-distal axle
27 Coil assembly
28 First leg
29 Underside of outer arm
30 Second leg
31 Widened portion
32 Recess of crossbar
33 Transverse edge (a, b)
34 Underside of insert
35 Extension of insert
36 Front end of one end
37 Longitudinal bore of insert
38 Entraining piston
39 Outer front end of entraining piston
40 Pressure chamber
41 Cut-out
42 End piece of coupling slide
43 Oblong hole
44 Outer wall of insert
45 Entraining surface
46 Spring
47 Closing element
48 Splash oil channel
49 Upper side of insert
50 Center strip
51 Side strip
52 Connecting metal sheet
53 End
54 End
55 Roller
56 Axle

The invention claimed is:

1. A switchable finger lever for a valve train of an internal combustion engine, the switchable finger lever comprising an inner lever with a U-shaped cross-section and further comprising, on one end, outer arms which are made separately from each other and are pivotable relative to the inner lever, the outer arms extending, while flanking outer walls of the inner lever, in a direction of an other end of the inner lever, the outer arms comprising on upper sides, running surfaces for high-lift cams, a support comprising integrally connected lateral guide tabs for at least one gas exchange valve extending on an underside of a crossbar of the inner lever in a vicinity of the one end, an insert comprising a contact surface for a head of a support element being installed on the other end between side walls of the inner lever, the insert further comprising a coupling slide for an optional connection of the outer arms to the inner lever, at least one resetting spring being clamped between the inner lever and the outer arms in a region of the other end, and at least one of the inner lever, alone, or the inner lever and the outer arms are made of thin-walled sheet metal.

2. The switchable finger lever of claim 1, wherein the insert is connected to the inner lever by at least one of force locking or positive engagement and force locking.

3. The switchable finger lever of claim 2, wherein, in a vicinity of two longitudinal ends, the insert comprises a cross-bore and an axle extends in each of said longitudinal ends, a lever-proximal one of said two axles is retained in bores of the side walls of the inner lever, and a lever-distal one of said two axles is likewise received in bores of the side walls of the inner lever or, front ends of the side walls of the inner lever have an open jaw-like configuration on the other end and end pieces of the lever-distal axle are received between jaw surfaces.

4. The switchable finger lever of claim 3, wherein the end pieces of the lever-distal axle project beyond the outer walls of the inner lever, each of said end pieces being surrounded by a coil assembly of a resetting spring configured as a torsion leg spring, a first leg of the resetting spring abuts against an underside of a respective one of the outer arms and a second leg of the resetting spring abuts against an outer one of the outer longitudinal ends of the insert.

5. The switchable finger lever of claim 4, wherein, for forming an assembled unit, the second legs are joined integrally to each other behind the outer longitudinal end.

6. The switchable finger lever of claim 1, wherein the inner lever has a U-shaped cross-section and merges in a direction of the other end into a widened portion in whose region the crossbar includes a recess in which the insert, while engaging over transverse edges of the recess, is seated through an extension projecting from an underside of the insert, said extension comprising the contact surface that is configured as a semi-spherical cavity.

7. The switchable finger lever of claim 1, wherein an underside of the extension of the insert extends flush, or almost flush, with the underside of the crossbar.

8. The switchable finger lever of claim 1, wherein the inner lever is a standard finger lever of a non-switchable type which, except for a recess for the insert in the crossbar, is substantially unmodified.

9. The switchable finger lever of claim 8, wherein the guide tabs of the inner lever are one of finger-like extensions which project integrally from front ends of the side walls of the inner lever on the one end while being bent onto the underside of the crossbar or, are webs formed or stamped out of the underside of the crossbar.

10. The switchable finger lever of claim 1, wherein the insert comprises above the contact surface, a longitudinal bore with an entraining piston for the a coupling slide therein, the entraining piston defines, with an outer front end, a pressure chamber for hydraulic medium which can be supplied out of the contact surface for displacement of the entraining piston in a coupling direction, the entraining piston comprises one of a transversely extending cut-out on an outer peripheral surface, or a transversely extending bore, and the coupling slide is seated in the cut-out or the transversely extending bore while being guided through end pieces in oblong holes extending crosswise through the insert and in longitudinal direction of the finger lever, the end pieces extend beyond outer walls of the insert and, for achieving coupling for a high valve lift, can be displaced in the direction of the one end partially in or under entraining surfaces of the outer arms ending in this region while, for achieving uncoupling for a low or zero valve lift, the coupling slide, with the end pieces can be moved out of the entraining surfaces in a direction of the other end through a force of at least one mechanical spring.

11. The switchable finger lever of claim 10, wherein the longitudinal bore in the insert starts from the outer longitudinal end of the insert on the other end and is closed in this region by a closing element, the pressure chamber for the hydraulic medium is formed between said closing element and the opposing outer front end of the entraining piston.

12. The switchable finger lever of claim 10, wherein one or more splash oil channels lead from an upper side of the pressure chamber, through the insert, to the upper side of the insert.

13. The switchable finger lever of claim 10, wherein the mechanical spring comprises a sheet metal clip made substantially as a hook-like center strip flanked by two identical hook-like side strips, the center and side strips project substantially perpendicularly from a central metal sheet that is seated behind an outer longitudinal end of the insert, the center strip extends over an upper side of the insert and is bent with an end to behind an inner longitudinal end of the insert and thus retains the spring, each of the side strips engages with pre-stress with a bent end behind a peripheral region of the respective end piece of the coupling slide on a side of the one end, so that the coupling slide is loaded in direction of the other end in the uncoupling direction.

14. The switchable finger lever of claim 1, wherein a rolling bearing-mounted or a slide bearing-mounted roller disk serving as a running surface of a low-lift cam for valve lift alteration or a zero lift cam for valve deactivation is received between the side walls of the inner lever.

15. The switchable finger lever of claim 1, wherein the running surfaces of the outer arms are cylindrically arched sliding surfaces.

16. The switchable finger lever of claim 1, wherein the inner lever with the outer arms extends on the one end on an axle extending crosswise through the inner lever and the outer arms.

* * * * *